United States Patent [19]

Bellanca

[11] Patent Number: 4,986,309

[45] Date of Patent: Jan. 22, 1991

[54] MAIN STEAM BY-PASS VALVE

[75] Inventor: Charles P. Bellanca, Maysville, Ky.

[73] Assignee: Dayton Power and Light Company, Aberdeen, Ohio

[21] Appl. No.: 401,143

[22] Filed: Aug. 31, 1989

[51] Int. Cl.[5] ..... F16K 1/12
[52] U.S. Cl. ..... 137/630.14
[58] Field of Search ..... 137/630.14, 630.15

[56] References Cited

U.S. PATENT DOCUMENTS

| | | | |
|---|---|---|---|
| 2,403,427 | 7/1946 | Ludeman | 137/630.14 X |
| 3,013,767 | 5/1957 | DeHaven . | |
| 3,892,382 | 7/1975 | Dresner | 137/630.14 X |
| 4,269,227 | 5/1981 | Araki | 137/630.14 |

FOREIGN PATENT DOCUMENTS

| | | | |
|---|---|---|---|
| 232304 | 4/1925 | United Kingdom | 137/630.14 |

OTHER PUBLICATIONS

Diagnostic Monitoring of Solid Particle Erosion in Steam Turbines, by Charles P. Bellanca, Jan. 30, 1987.

*Primary Examiner*—Robert G. Nilson
*Attorney, Agent, or Firm*—Killworth, Gottman, Hagan & Schaeff

[57] ABSTRACT

Re-orientation of inlet ports to a by-pass valve which is used in industrial gas process systems to control the gas stream during system start-up, significantly reduces solid particle erosion of by-pass valve components and reduces costly system downtime for maintenance of by-pass valves.

9 Claims, 4 Drawing Sheets

FIG-2
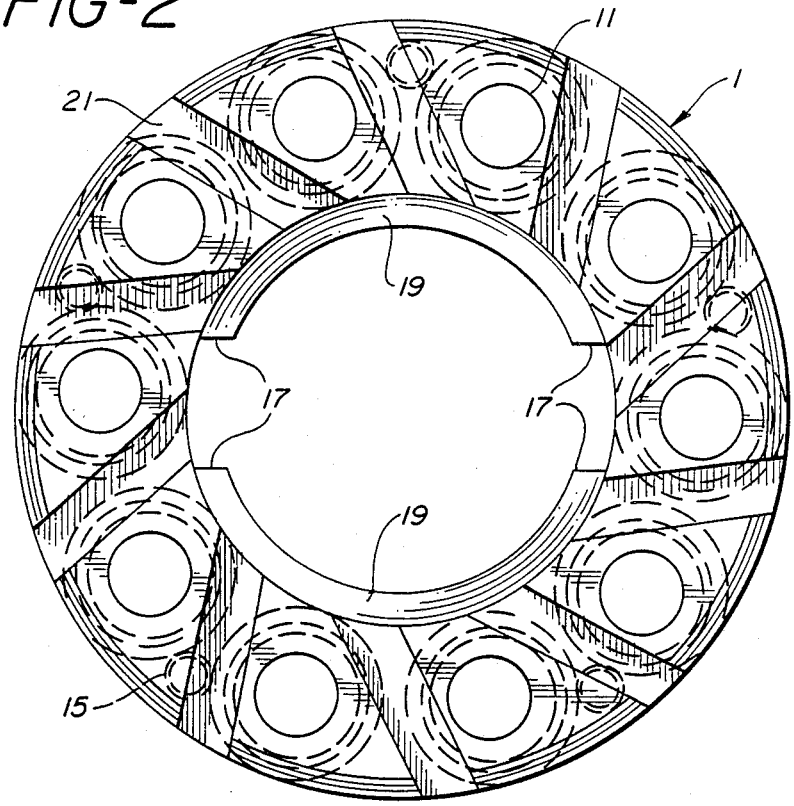
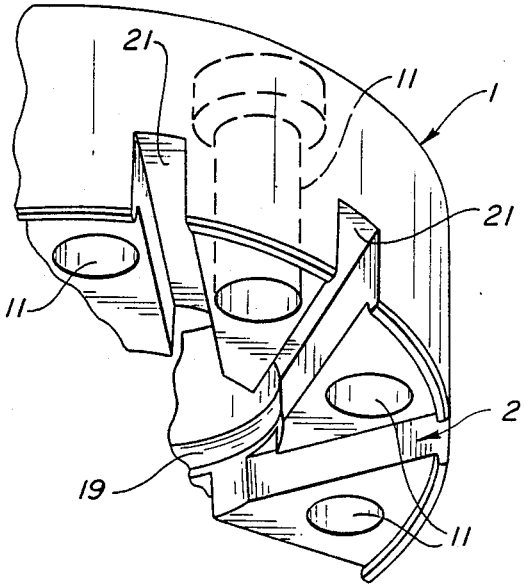
FIG-3

MAIN STEAM BY-PASS VALVE

BACKGROUND OF THE INVENTION

This invention relates to a valve for use in industrial gas process sYstems, and, in particular, to a main steam stop valve by-pass valve for steam turbine applications.

In the operation of steam turbines in commercial power plants, stop valve by-pass valves (SVBV) play an important role in turbine start-up. During start-up, the gas stream is throttled and controlled at the SVBV only. As a result, start-up and initial loading of the steam turbine may be accomplished with all control valves wide open, resulting in uniform steam flow and warming to all turbine shell passages. The SVBV itself is typically mounted inside a larger master valve assembly, such as a stop valve assembly, wherein the SVBV functions as the valve disc. For purposes of illustration, the discussion which follows will focus on the use of an SVBV in a stop valve assembly. The SVBV performs its by-pass function when the stop valve is closed. Thus, the SVBV, as its name implies, functions as a valve within a valve.

Typically, an SVBV is comprised of a number of components, the largest of which is the stop valve disc. The master valve disc is that part of the SVBV which seats in the stop valve assembly, and includes the outlet ports of the SVBV. Inside the SVBV, a by-pass disc is mounted on a stem which is slidably inserted in the center of the master valve disc, and functions to open or close the SVBV. A valve cap with inlet ports is mounted on the top of the stop valve disc. When the by-pass disc is moved down to seat in a first position in the stop valve disc, the steam flow is restricted or stopped. As the by-pass disc is moved upward, an annulus is created between the by-pass disc and the stop valve disc and steam flows through the SVBV. At a point maximum upward travel, the by-pass disc seats in a second position in the valve cap, and the steam annulus within the stop valve disc is wide open to the inlet and outlet ports. Thus, steam or gas flows freely through the inlet ports and annulus to the outlet ports in the stop valve disc. U.S. Pat. No. 3,013,767 is typical of such components present in prior art valve assemblies.

Problems arise in the operation of steam turbines, as in the operation of other industrial gas process systems, when solid particles carried by the gas stream impinge upon and erode pipes, valves and other process equipment. In particular, steam carries microscopic oxide particles that spall from high temperature boiler tubes, steam headers, and steam piping. High velocity flow and changes of direction cause the particles to impact on stationary nozzles, rotating blades, and valve surfaces, causing erosion. The rate of solid particle erosion is dependent in part on the size, velocity and angle of impact of solid particles, and on the number and duration of turbine start-ups. The central role of the SVBV in turbine start-up subjects the by-pass disc to significant erosion, requiring its replacement at regular intervals to avoid disc failure and forced outages. Solid particle erosion is a long-standing, industry-wide problem with significant economic impact upon operation and maintenance costs, as well as availability and performance, of the nation's power plants.

Thus, reduction or elimination of solid particle erosion of SVBVs in steam turbine applications, as well as in similarly demanding industrial gas process environments, is desirable to decrease operation and maintenance costs and improve system performance.

SUMMARY OF THE INVENTION

The present invention meets this need by simply, but effectively, achieving significant reduction in solid particle erosion by redirecting the angle at which the particles impinge on the external surface of the by-pass disc from normal to substantially tangential.

The key feature of the invention is the design of the valve cap and stop valve disc, which in combination provide inlet ports so oriented that oxidation particles present in the gas stream impinge in a generally tangential rather than normal direction upon the by-pass disc. While generally tangential orientation is preferred, orientation of the inlet ports at other angles will achieve some reduction in solid particle erosion. In an alternative embodiment the inlet ports are provided entirely within the valve cap.

As may be seen by one skilled in the art, the SVBV has a wide range of applications in industrial gas process systems. When configured as a valve within a valve, the SVBV may be used in connection with any number of master valves, such as a throttle valve, control valve, or the like, as with a stop valve. Use of the SVBV with master valves having one or more inlets and one or more outlets is also contemplated. Similarly it may be seen by one skilled in the art that the SVBV may, with minor modification, function separately and find application as a stop valve, control valve, by-pass valve or the like for gases or fluids, without departing from the scope of the invention.

BRIEF DESCRIPTION OF THE DRAWINGS

FIG. 2 is a bottom view of the valve cap.

FIG. 3 is a partial perspective view of FIG. 2.

DETAILED DESCRIPTION OF THE PREFERRED EMBODIMENTS

Figure 1:
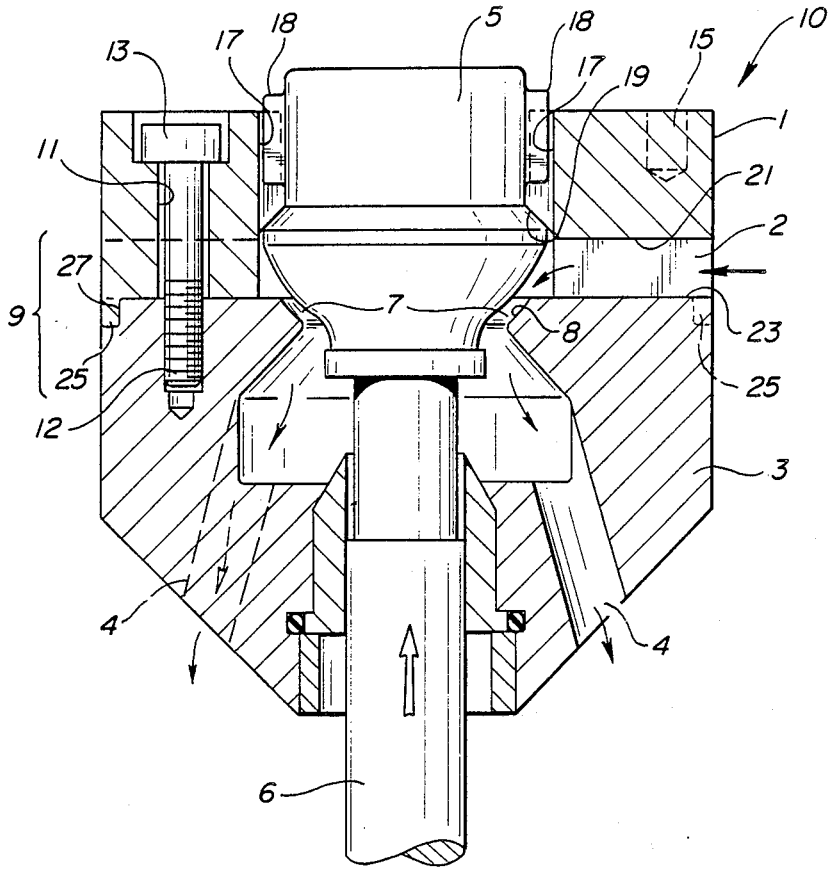
FIG. 1 is a cross-section of the preferred embodiment of the SVBV of the present invention, shown in a second position.

In FIG. 1, the structure and operation of the stop valve by-pass valve (SVBV) 10 of the present invention is shown schematically in cross-section. FIG. 2 shows the angular orientation of inlet ports 2 as substantially tangential to the surface of by-pass disc 5. While substantially tangential orientation on the same plane is preferred for inlet ports 2, inlet ports 2 may be skewed vertically in non-planar orientation as in FIG. 4, or in an angular relation less than substantially tangential, and still achieve reduction in solid particle erosion of the SVBV 10.

Figure 4:
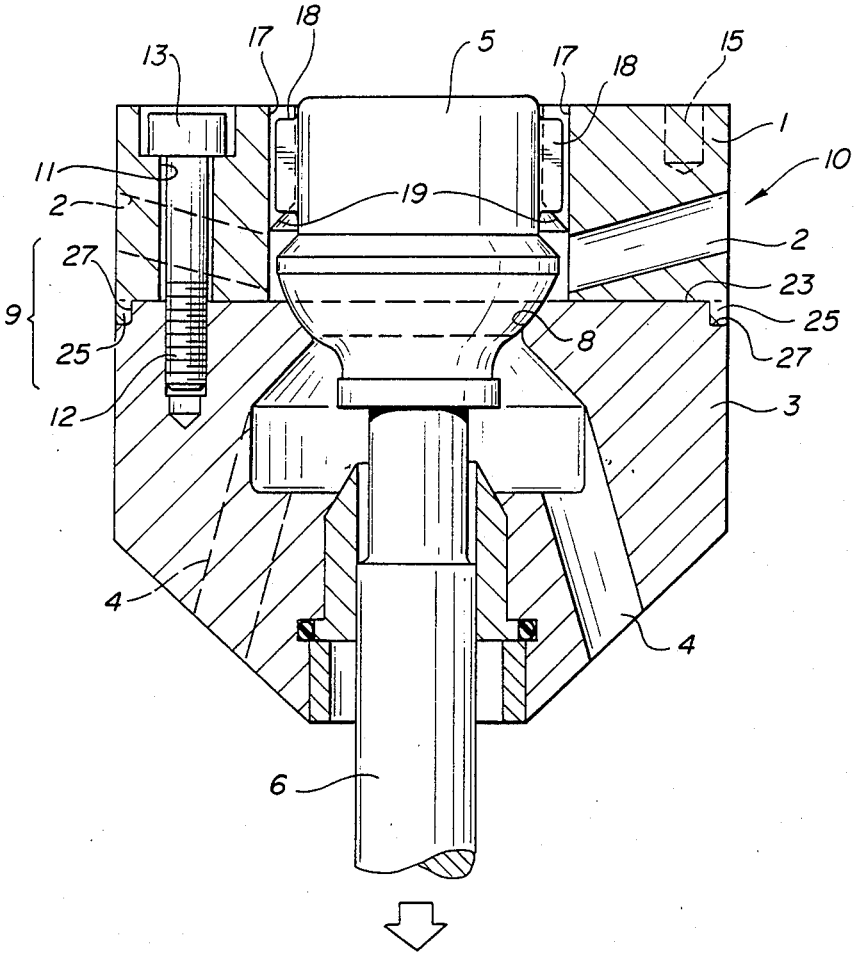
FIG. 4 is a cross-section of the SVBV in an alternative embodiment shown in a first position.

Referring to FIG. 1, by-pass valve body 9 of SVBV 10 is comprised of stop valve disc 3 and valve cap 1. Valve cap 1 is fastened to stop valve disc 3 by conventional means, such as bolts 13 through bolt holes 11 into tapped holes 12 as shown. In addition, inter-relating profiles, such as lip 25 and groove 27, further secure valve cap 1 to stop valve disc 3. By-pass disc 5 is slidably disposed in valve cap 1 and is mounted on valve stem 6 by conventional means, such as welding, threaded connection or the like. A threaded connection is preferred and is oriented so that spin imparted to by-pass disc 5 by solid particles and gas from inlet ports 2 tends to tighten by-pass disc 5 onto valve stem 6. As shown in FIGS. 1, 2 and 4, by-pass disc orientation is maintained by guides 18 which ride in keyways 17 in valve cap 1.

Referring again to FIG. 1, by-pass disc 5 is shown seated in valve cap 1 in a second (open) position against valve cap seat 19. Valve cap seat 19 is further shown in FIG. 2. In this second position, an annular space 7 is opened between the outer periphery of by-pass disc 5 and stop valve disc 3, allowing free flow of gas or steam from the inlet ports 2 to the outlet ports 4 defined in the stop valve disc 3. In contrast, FIG. 4 shows by-pass valve disc 5 in a first (closed) position, wherein by-pass disc 5 is brought into contact with valve seat 8 to provide a positive shut-off of gas or steam flow. As by-pass disc 5 moves from a first (closed) to a second (open) position, the precise angular orientation of inlet ports 2 relative to the surface of by-pass disc 5 varies due to the curved profile of by-pass disc 5. The angular orientation of inlet ports 2 is therefore defined as substantially or generally tangential, and describes a range of angles wherein reduction in solid particle erosion may be achieved.

In the preferred embodiment, of FIG. 1, inlet ports 2 are formed by combining the valve cap inlet grooves 21 with top surface 23 of stop valve disc 3. Inlet grooves 21 are shown in more detail in FIGS. 2 and 3. FIG. 4 shows an alternative embodiment wherein the inlet ports are entirely defined within valve cap 1.

Figure 5:
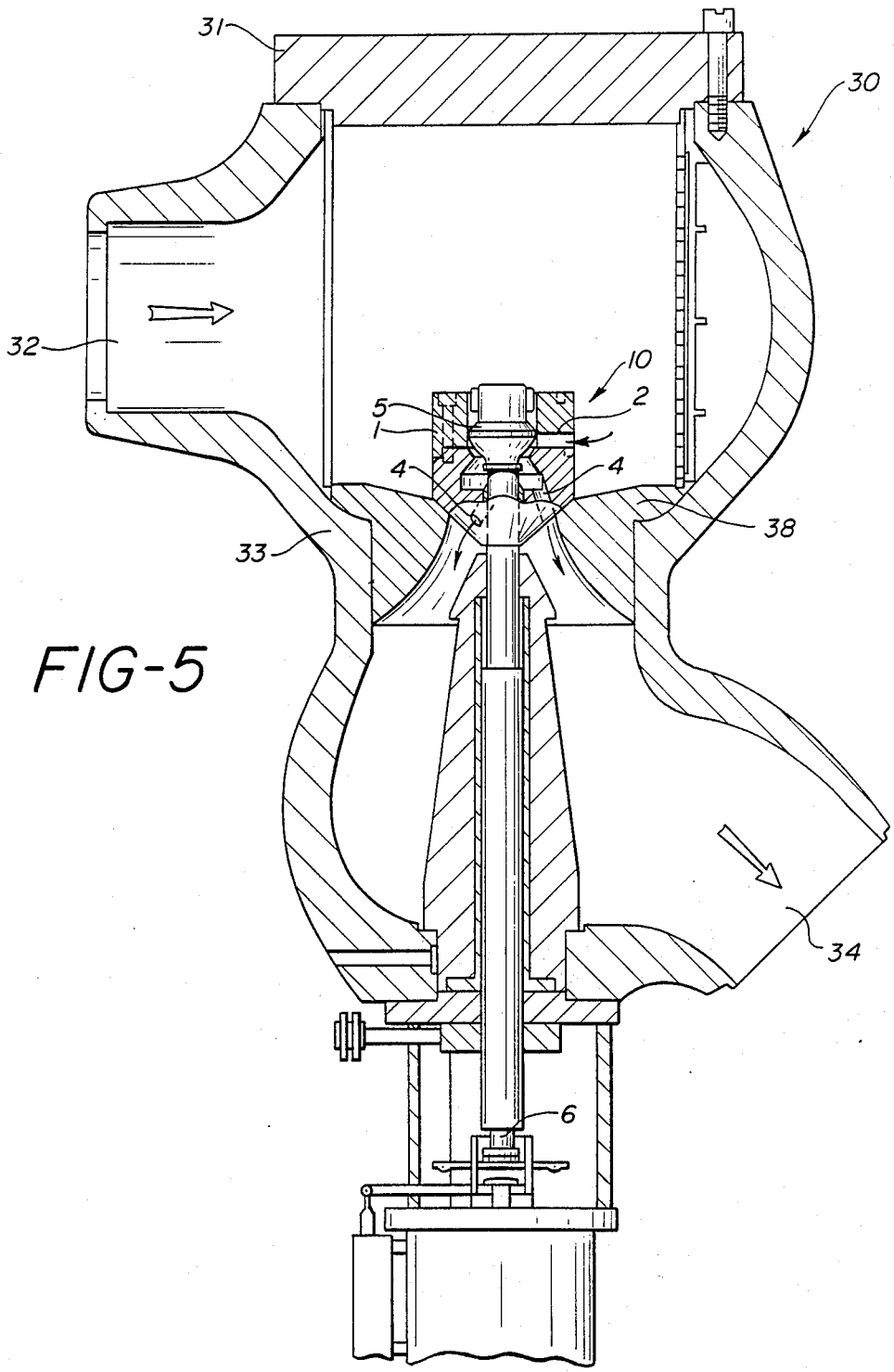
FIG. 5 is a cross-section of a typical stop valve showing the SVBV in position as the stop valve disc where it functions as a by-pass valve.

Referring now to FIG. 5, a SVBV 10, as recited above having inlet ports 2 in generally tangential or angular orientation to by-pass disc 5, is disposed within stop valve 30. SVBV 10 is connected to valve stem 6 which is slidably inserted into stop valve body 33. So connected, the stop valve disc 3 of SVBV 10 may be brought in and out of communication with stop valve seat 38 to restrict or stop the flow of gas or steam from stop valve inlet 32 to stop valve outlet 34.

Tapped holes 15, shown in phantom in FIGS. 1, 2, 4, and 5, may be provided for attaching lifting lugs (not shown) to SVBV 10 to facilitate its installation in stop valve 30.

The outer profile of the stop valve disc 3 is not critical to the invention disclosed herein, and may, without interfering with inlet port design, be modified to adapt an SVBV for use in valves of various sizes.

When seated in stop valve seat 38, as shown in FIG. 5, SVBV 10 performs as a by-pass valve. The position of by-pass disc 5 is adjusted by operation of valve stem 6. When by-pass disc 5 is at its full open position, further upward operation of valve stem 6 opens stop valve 30.

Additional aspects and details of assembly of the SVBV in the stop valve are conventional. Valve stem seals for valve stem 6, and seals between mating surfaces such as those between valve cap 1 and stop valve disc 3, upper head 39 and valve cap 1, and upper stop valve head 31 and stop valve body 33 are made by gasket, packings or machined fit such as are known in the art. As well, the by-pass valve 10 and stop valve 30 are constructed of metal alloys known and commonly used in the art, preferably 2 ¼% Chromium 1% Molybdenum steel, and valve seat 8 and stop valve seat 38 are, preferably, constructed of commercially available Stellite cobalt compound and are fastened at their respective positions as is commonly known in the art.

Although outlet ports 4 have been shown in FIGS. 1, 4 and 5 directed outward away from the central axis of the SVBV as is preferred for use of SVBVs in a stop valve, it is readily apparent to those skilled in the art that the outlet ports could be disposed otherwise, e.g., in the direction of the valve stem 6, and still perform their discharge function.

While certain representative embodiments and details have been shown for purposes of illustrating the invention, it will be apparent to those skilled in the art that various changes in the valve disclosed herein may be made without departing from the scope of the invention, which is defined in the appended claims.

What is claimed is:

1. A stop valve comprising:

a stop valve body having one or more inlets and one or more outlets;

a stop valve by-pass valve adjustably positioned within said stop valve body and adapted to seat in said stop valve;

said stop valve by-pass valve comprising a by-pass valve body having one or more inlet ports extending from an outer surface to an inner surface and one or more outlet ports, a by-pass disc having a central axis and slidably disposed in said by-pass valve body for movement parallel to said central axis, and wherein said one or more inlet ports extend from said outer surface to said inner surface in a direction not intersecting said central axis; and means for adjusting the position of said stop valve by-pass valve and the position of said by-pass disc.

2. A stop valve as recited in claim 1 wherein said by-pass valve body comprises a valve cap defining said one or more inlet ports, a stop valve disc defining said one or more outlet ports, and means for fastening said valve cap to said stop valve disc.

3. A stop valve as recited in claim 1 wherein said by-pass valve body comprises a valve cap having one or more grooves, a stop valve disc defining said one or more outlet ports, and means for fastening said valve cap to said stop valve disc, whereby said grooves form said one or more inlet ports in said by-pass valve body.

4. A stop valve as recited in claim 1 wherein said by-pass valve body further comprises a by-pass valve seat for seating said by-pass disc in a first, substantially closed position, whereby flow to said one or more outlet ports may be substantially restricted.

5. A stop valve as recited in claim 1 wherein said one or more inlet ports are disposed in a plane perpendicular to said axis.

6. A stop valve as recited in claim 1 wherein said means for adjusting the position of said stop valve by-pass valve and the position of said by-pass disc comprises a valve stem slidably inserted both in said stop valve body and in said by-pass valve body and connecting to said by-pass disc, whereby said valve stem adjusts the position of said by-pass disc at or between a first, substantially closed position, and a second, substantially open position in said by-pass valve body, and said valve stem adjusts the position of said stop

7. A stop valve comprising:

a stop valve body having one or more inlets and more or more outlets;

a stop valve by-pass valve adjustably positioned within said stop valve body and adapted to seat in said stop valve, wherein said stop valve by-pass valve comprises a by-pass valve body having one or more inlet ports and one or more outlet ports and a by-pass disc slidably disposed in said by-pass valve body, wherein said inlet ports are in generally tangential orientation to the outer periphery of said by-pass disc, and wherein said by-pass valve body is further comprised of a valve cap having one or more grooves, a stop valve disc defining said outlet ports, and means for fastening said valve cap to said stop valve disc, whereby said grooves form said inlet ports in said by-pass valve body; and means for adjusting the position of said stop valve by-pass valve and the position of said by-pass disc.

8. A stop valve comprising:

a stop valve body having one or more inlets and one or more outlets;

a stop valve by-pass valve adjustably positioned within said stop valve body and adapted to seat in said stop valve, wherein said stop valve by-pass valve comprises a by-pass valve body having two or more inlet ports and one or more outlet ports and a by-pass disc slidably disposed in said by-pass valve body, and wherein said two or more inlet ports are disposed in the same plane in generally tangential orientation to the outer periphery of said by-pass disc; and means for adjusting the position of said stop valve by-pass valve and the position of said by-pass disc.

9. A stop valve comprising:

a stop valve body having one or more inlets and one or more outlets;

a stop valve by-pass valve adjustably positioned within said stop valve body, adapted to seat in said stop valve, wherein said stop valve by-pass valve comprises a by-pass valve body having one or more inlet ports and one or more outlet ports and a by-pass disc having a central axis and slidably disposed in said by-pass valve body for movement parallel to said central axis, and wherein said one or more inlet ports are disposed in at least one plane perpendicular to said central axis, and said one or more inlet ports are in generally tangential orientation to the circumference of said by-pass disc as defined in said at least one plane perpendicular to said central axis; and means for adjusting the position of said stop valve by-pass valve and the position of said by-pass disc.

* * * * *

UNITED STATES PATENT AND TRADEMARK OFFICE

CERTIFICATE OF CORRECTION

PATENT NO. : 4,986,309

DATED : January 22, 1991

INVENTOR(S) : Charles P. Bellanca

It is certified that error appears in the above-identified patent and that said Letters Patent is hereby corrected as shown below:

Col. 1, Line 6, "sYstem" should be --system--.

Col. 1, Line 31, "the master valve" should be --the stop valve--.

Col. 1, Line 39, "point maximum" should be --point of maximum--.

Col. 3, Line 26, "embodiment, of FIG.1," should be --embodiment of FIG.1,--.

Col. 3, Lines 66/67, "Stellite cobalt" should be --Stellite R cobalt--.

Col. 4, Line 65, "said stop" should be --said stop valve by-pass valve when said by-pass valve is at said first and second positions.--.

Signed and Sealed this

Eighth Day of September, 1992

*Attest:*

DOUGLAS B. COMER

*Attesting Officer*

*Acting Commissioner of Patents and Trademarks*